United States Patent [19]

Kranz

[11] Patent Number: 4,589,594

[45] Date of Patent: May 20, 1986

[54] THRUST NOZZLE SYSTEM

[75] Inventor: Walter Kranz, Taufkirchen, Fed. Rep. of Germany

[73] Assignee: Messerschmitt-Boelkow-Blohm Gesellschaft mit beschraenkter Haftung, Munich, Fed. Rep. of Germany

[21] Appl. No.: 605,286

[22] Filed: Apr. 30, 1984

[30] Foreign Application Priority Data

May 13, 1983 [DE] Fed. Rep. of Germany ..... 3317583

[51] Int. Cl.[4] ..... F42B 15/033

[52] U.S. Cl. ..... 239/265.25; 60/229; 60/230; 244/3.22

[58] Field of Search ..... 239/265.11, 265.19, 239/265.25, 265.27, 251, 252, 257, 258; 60/228–230, 232, 271; 244/3.22, 52

[56] References Cited

U.S. PATENT DOCUMENTS

| | | | |
|---|---|---|---|
| 3,125,297 | 3/1964 | Copeland et al. | 239/251 |
| 4,441,670 | 4/1984 | Crepin | 60/229 X |
| 4,463,921 | 8/1984 | Metz | 239/265.27 X |
| 4,482,107 | 11/1984 | Metz | 239/265.19 X |

FOREIGN PATENT DOCUMENTS

| | | |
|---|---|---|
| 2809281 | 9/1979 | Fed. Rep. of Germany . |
| 2094240 | 9/1982 | United Kingdom . |

*Primary Examiner*—Andres Kashnikow

*Attorney, Agent, or Firm*—W. G. Fasse; D. H. Kane, Jr.

[57] ABSTRACT

The invention relates to a thrust nozzle system, especially for steering a projectile, having a nozzle arrangement (3) which is fed by a propellant source, for example a gas source. The nozzle system is arranged in a housing having at least one exhaust port (11) provided in the housing, and has a control (14) for steering a thrust jet (18) of the nozzle arrangement through the exhaust port. The invention provides a thrust nozzle system of simple construction which is especially suitable for a high miniaturization, and which permits a flexible thrust impulse forming. For this purpose the thrust nozzle system (2) has a rotating nozzle or a swinging nozzle body (3) which is rotatable relative to the housing about an axis, driven by the propellant, for example by the gas stream (P) from the gas source. The drive of the rotating nozzle body is preferably achieved by an acentric thrust nozzle (10) itself. Due to the low mass and hence low inertia of the nozzle body (3), it may be caused to rotate fast. A braking arrangement (14) is provided for the rotating nozzle body for steering the thrust jet (18) in a defined direction. Such a thrust nozzle system may serve for many uses, for example in conjunction with a secondary injection system or a hot gas motor.

10 Claims, 9 Drawing Figures

THRUST NOZZLE SYSTEM

FIELD OF THE INVENTION

The invention relates to a thrust nozzle system according to the preamble of the patent claim 1.

DESCRIPTION OF THE PRIOR ART

Such thrust nozzle systems are used in all those instances, when a thrust force is to be applied in a certain direction by means of a gas stream or jet. Such an example is described in German Patent Publication DE-OS No. 2,809,281, relating to a control arrangement for a projectile of the autorotation type, wherein, the projectile comprises a plurality of small impulse generators in the form of miniature propulsion units, which are arranged and distributed around the circumference of the projectile and in front of the center of gravity thereof. A control arrangement is provided for the miniature propulsion units. By means of this control arrangement, the propulsion units are triggered in a prescribed or variable direction at a prescribed or variable frequency, in accordance with a steering control rule or the like. Such a miniature propulsion unit, or a combination of several propulsion units, is activated for a certain time at a determined rotational position of the projectile and depending on the desired direction of the thrust force. Thus, a steering force is exerted on the projectile. Such a thrust nozzle system may be used especially and advantageously in fast-flying projectiles having a short flight duration. Due to the arrangement of the thrust nozzle system close to the nose cone of the projectile, high steering forces may be achieved even with small thrust forces.

However, the system described in the above German Patent Publication is constructively quite costly and complicated, whereby limits are set for the possible miniaturization. Also, the thrust peak and thrust duration are fixed from the start, that is, the thrust impulse is fixed.

OBJECTS OF THE INVENTION

It is the object of the invention, to constructively simplify a thrust nozzle system of the type at hand, so that even the complete system may be constructed in a highly miniaturized way. Furthermore, the thrust nozzle system should be activatable without any noticeable inertia or sluggishness by means of a flexible thrust impulse, that is with a variable thrust strength and thrust duration.

SUMMARY OF THE INVENTION

This object is achieved according to the invention by the features of the characterizing clause of patent claim 1.

According to the features of the invention, the thrust nozzle system comprises a single rotating nozzle body with at least one thrust nozzle, which is driven by a propellant source, such as a gas source, for example a separate gas generator, or, in flying bodies, by branching off gases from the propulsion unit. Such a gas stream is preferably simultaneously used as a thrust jet. The rotating nozzle body rotates at a very high speed, and is very strongly accelerated at the start of the motion due to its low moment of inertia. The direction control of the thrust jet is achieved in that the rotating nozzle body is braked by means of suitable devices, whereby the relative rotation between the rotating nozzle body and the housing is changed. If the braking device is released, the rotating nozzle body is again almost immediately accelerated to the original rotational speed due to its very low moment of inertia.

Due to such construction, the thrust nozzle system according to the invention may be built considerably smaller than prior art arrangements of this type. Thus, the present system lends itself, for example, as a control system for fast-flying rotating or non-rotating shells of small caliber. Likewise, a thrust nozzle system according to the invention may be used as part of a secondary injection system. Depending on the position of the rotating nozzle body, a propellant or propellant gas is injected by the rotating nozzle into the propulsion stream of a main propulsion unit. However, in a different position, the thrust force of the thrust nozzle system itself serves, for example, for the sideways or rotational acceleration of the body to be controlled, or for assisting the forward motion of the body. A further possibility of use is, for example, the control of rotary motors with free pistons known as such, whereby the free pistons may be impinged upon by the thrust jet of a thrust nozzle system according to the invention. Such a rotary motor has the advantage of a large speed reduction and the advantage of fast switching or shifting due to the low inertia of the thrust nozzle system. The braking device or arrangement required by the thrust nozzle system may be constructed differently according to the specific use. Customarily, a fast-acting braking system would be used, in order to take advantage of the low inertia of the thrust nozzle system. Mechanical or also electro-magnetic clutches or the like are suitable for this purpose. The control arrangement may be controlled by a sensor, which for example in a flying body measures the deviation of the flying body from a prescribed course and provides corresponding commands to the thrust nozzle system, or to its braking arrangement. Besides, the flow and pressure conditions inside the nozzle system may be advantageously used to assist in the control. The last mentioned possibility lends itself, for example, for use in the described rotary motor, wherein the rotating nozzle body is shifted or stepped when each piston space of the currently impinged free piston is filled with propellant gas.

BRIEF DESCRIPTION OF THE DRAWINGS

The invention is described in more detail by several example embodiments with reference to the drawings, wherein.

DETAILED DESCRIPTION OF PREFERRED EXAMPLE EMBODIMENTS AND OF THE BEST MODE OF THE INVENTION

In all the figures, the same reference numbers are used for the same elements, or for those elements having the same function. However, a respective number of the example embodiment is added after a dash to each reference number.

Figure 1:
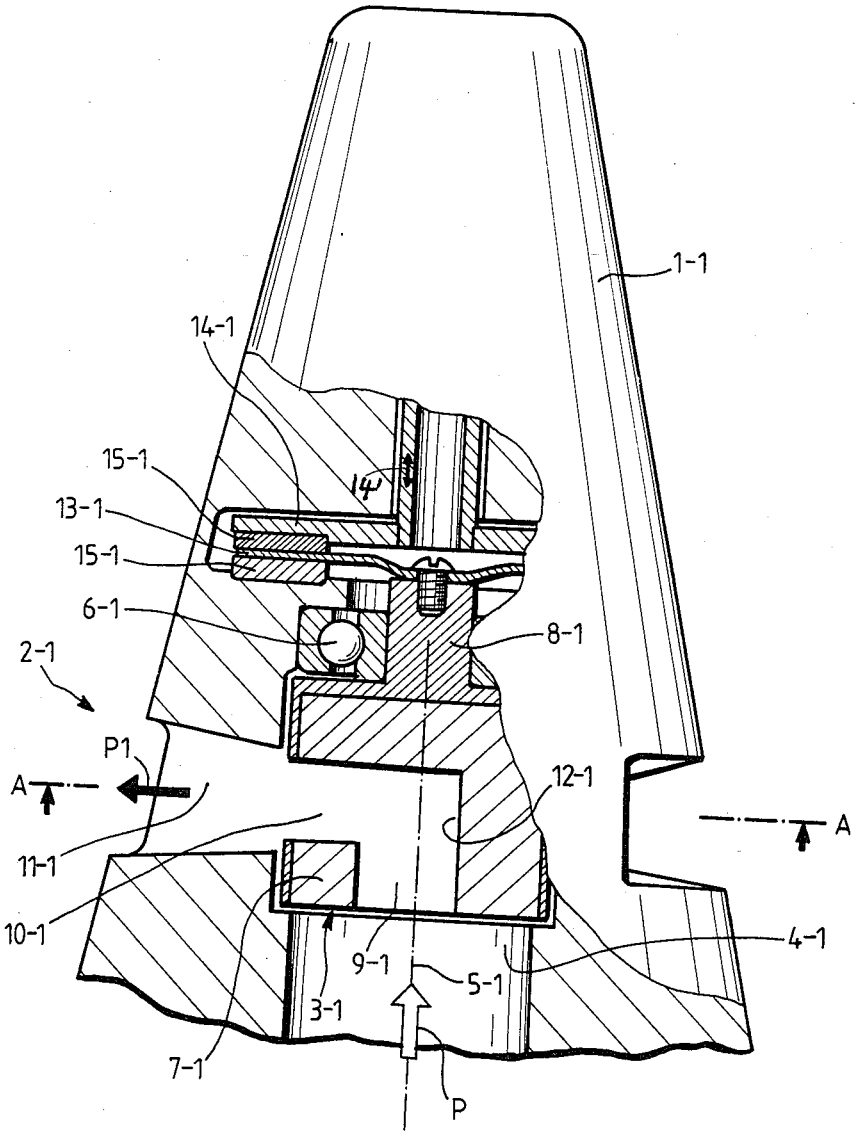
FIG. 1 shows a cross-section through the nose of a projectile or shell having a thrust nozzle system according to the invention for steering the projectile.

FIG. 1 shows a tip of a projectile 1—1, partially sectioned. The projectile 1—1 is equipped with a thrust nozzle system 2-1 for steering the projectile. This thrust nozzle system comprises a rotating jet deflector nozzle body 3-1 in the tip of the projectile. The rotating nozzle body 3-1 is mounted in a central bore 4-1 so as to be rotatable about the lengthwise axis 5-1 of the projectile. In the embodiment shown here, the rotating nozzle body is merely mounted at its upper end by a ball bearing arrangement 6-1. The lower end (not shown) of the central bore holds a gas source (also not shown), for example, a gas generator. The gas stream from the gas generator flows in the direction toward the rotating nozzle body 3-1, as shown by the arrow P. The rotating nozzle body 3-1 comprises a lower cylindrical part 7-1, which has approximately the clear width of the central bore 4-1. The nozzle body 3-1 further comprises an upper neck part 8-1 by which the rotating nozzle body is held by means of the ball bearing arrangement 6-1. A lengthwise bore 9-1 is provided in the cylindrical part 7-1, and such bore leads at a right angle into an eccentric bore 10-1 leading to the outside. The eccentric bore 10-1 serves as a thrust nozzle. The thrust nozzle is oriented along a chord which does not pass through the rotation axis 5-1 and hence is spaced from the rotation axis as shown in the drawings. In this case, three exhaust ports 11-1 are arranged in the projectile wall in the area of the thrust nozzle 10-1, to lead to the outside from the central bore 4-1. If the thrust nozzle 10-1 and one of the exhaust ports 11-1 communicate with each other, then the gas stream or thrust jet supplied by the gas source is steered or directed to the outside, in FIG. 1 approximately horizontally in the direction of the arrow P1. This thrust jet acts against the rear wall here referred to as 12-1 of the thrust nozzle 10-1, so that a force is applied to the projectile in a direction opposed to the arrow P1. Simultaneously, the rotating nozzle body is rotated by the eccentric thrust nozzle at a high velocity about the rotation axis.

A brake disk 13-1 is mounted at the upper end of the neck part 8-1. The brake disk 13-1 is rigidly secured to the jet deflector nozzle body and may be arrested by a clutch type braking arrangement 14-1 including a further brake disk which is axially movable as shown by the double arrow 14'. For the braking purpose the brake disk 13-1 is clamped in between two friction members or disks 15-1 which lie on opposite sides of the brake disk 13-1. The braking arrangement is controlled by a control mechanism or sensor mechanism which is not shown here but which moves the further disk axially for stopping the nozzle body 3-1 in any position. If the brake disk 13-1 is stopped, then simultaneously the rotating nozzle brake 3-1 rigidly connected thereto is also stopped.

As shown in FIGS. *2a* and *2b*, the exhaust ports 11-1 each span a relatively large angle of nearly 90°, and are separated from one another by separation struts 16-1. The surfaces of the separation struts which face the thrust nozzle 10-1 are embodied as flat impingement surfaces 17-1. However, an interspace 19-1 remains between each impingement surface 17-1 and the rotating nozzle 3-1.

The mode of operation of the described thrust nozzle system will be described in the following with reference to FIGS. *2a* and *2b*.

Due to the eccentric arrangement of the thrust nozzle 10-1, a rotational moment is applied to the rotating nozzle by the thrust jet 18-1 indicated in FIG. *2a*, whereby, the rotating nozzle is rotationally displaced in the direction of the arrow, in this case clockwise. Due to the small mass of the rotating nozzle, the rotational velocity may be high in accordance with the stream velocity of the gas P from the gas source. It is assumed that the projectile does not rotate. If the rotating nozzle runs freely, then the thrust jet 18-1 alternately sweeps at high velocity across the exhaust ports 11-1 and the separation struts 16-1. If the rotational velocity of the rotating nozzle is sufficiently fast, then, on average, this would correspond to a null or zero command. A null command may, however, also be achieved as shown in FIG. *2b* in that the rotating nozzle 3-1 is held by means of a braking arrangement 14-1 in such a position that the thrust stream 18-1 impinges upon an impingement surface 17-1 of one of the separation struts 16-1. In an exact rotational position of the nozzle, the thrust jet will be split into two portions, which point in opposed directions, as shown by the arrows in FIG. *2b*, so that the resultant is null. Furthermore, a null command may be achieved in that the thrust forces are equally distributed on all the exhaust ports by means of an appropriate construction of the separation struts between the exhaust ports. A further possibility of achieving a null command exists in that a deflector member may be provided for the thrust stream in the area of the separation struts. The thrust jet would thereby, for example, be deflected into a ring conduit which has exhaust ports distributed around the entire circumference. Additional connections with the available exhaust ports may also be provided. Such construction increases the costs, yet in certain cases this may be justified, if a high symmetry of the thrust distribution is desired.

If a force in a certain direction is to be applied to the nonrotating flying body, then the rotating nozzle is held fixed in one position by means of the braking arrangement 14-1, for example shown in FIG. *2a*, whereby the position is such that the thrust jet 18-1 points out through one of the exhaust ports 11-1 in a direction opposed to the desired direction. If a different direction is desired, then the braking arrangement 14-1 is released and thereafter reactivated when the thrust stream points in the new direction. It is advantageous for steering a projectile, if the projectile itself rotates in a direction opposite to the rotating nozzle 3-1. This feature especially has the advantage that the transition time between a full command as in FIG. *2a* and a null command as in FIG. *2b* is reduced. Regarding the sector angle of the exhaust ports 11-1 it should be considered that with wide exhaust ports, the gas stream of the gas source, for example of a gas generator, is utilized very efficiently for a defined full-command corresponding to FIG. *2a*. If the exhaust ports are only narrow, the gas generator is utilized to a considerably lesser extent since the thrust jet does not escape to the outside over a large sector angle, but instead strikes onto impingement surfaces. On the other hand, with large exhaust ports the transition time between a full command and a null command is greater than with small exhaust ports. Here an optimization must be achieved. For the case of an optimal utilization of the gas source in a projectile steering system, the rotating nozzle and the projectile should rotate in opposed directions, and the exhaust ports should be rather large. Despite the rotation of the flying body, the thrust jet may then be held in a defined direction for a long time without much steering control and without striking separation struts. For the case of the shortest possible thrust impulse and for a fast directional change, the exhaust ports should remain small, and the projectile and the rotating nozzle body should rotate in the same direction, for example.

Figure 2A:
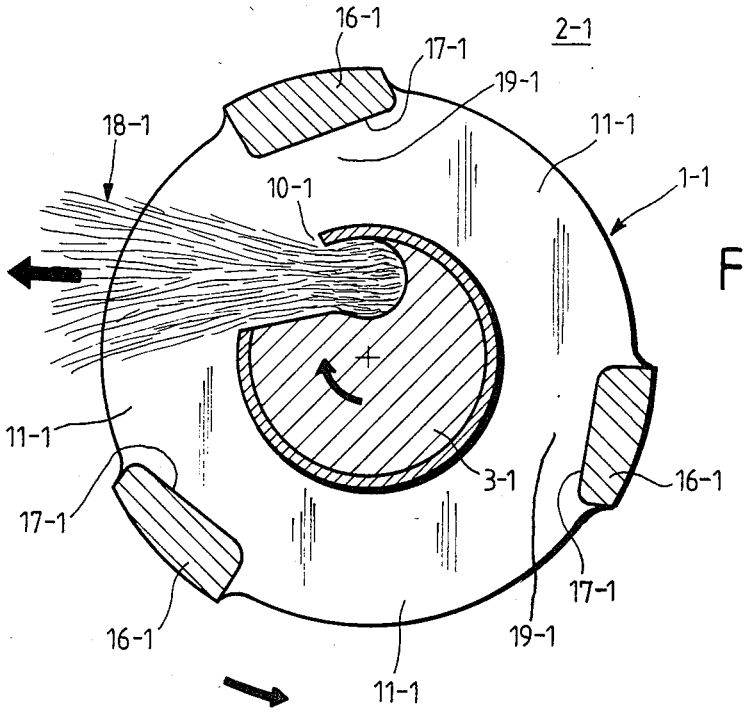
FIGS. 2*a* and 2*b* show a cross-section through a thrust nozzle system, in two positions, corresponding to the section A—A in FIG. 1.
Figure 2B:
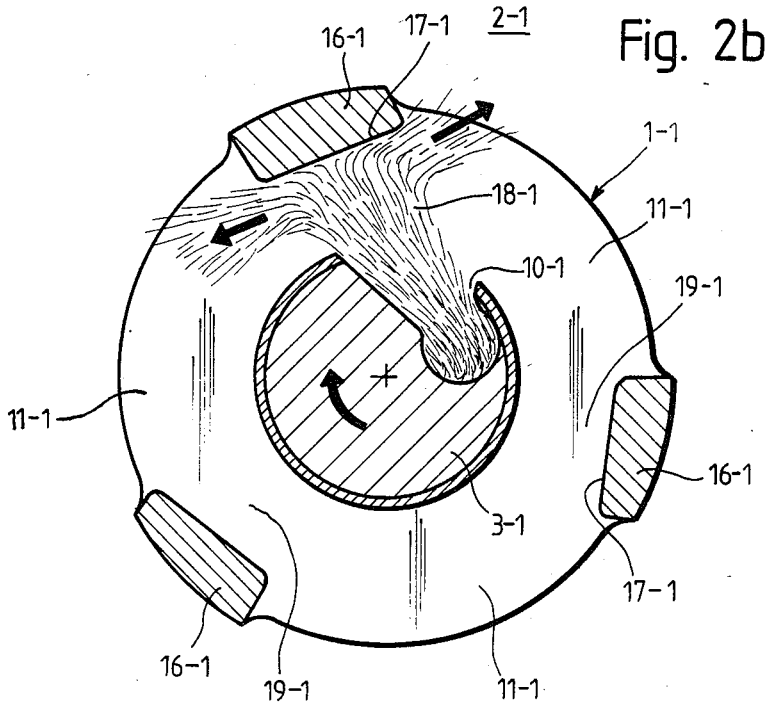
Figure 3A:
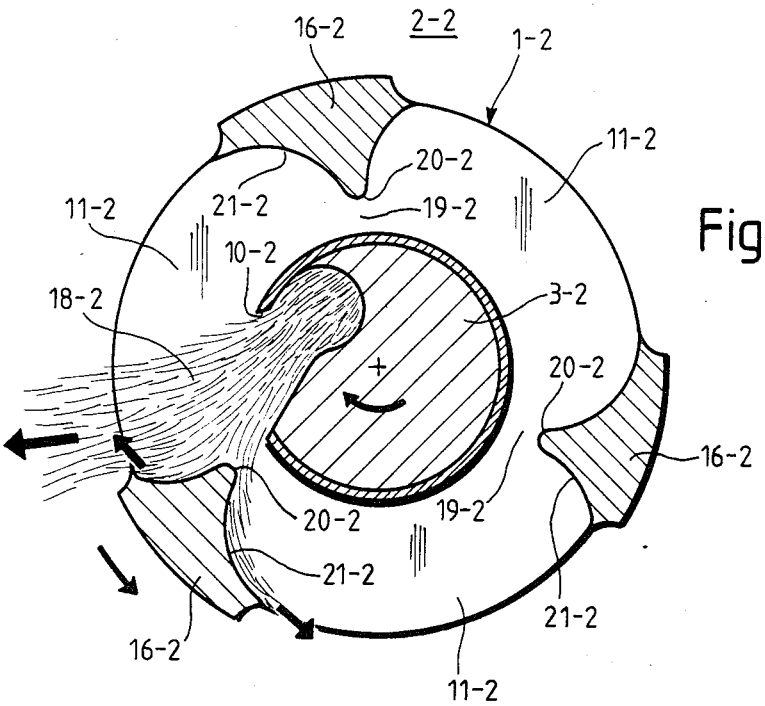
FIGS. 3*a* and 3*b* show a section corresponding to FIG. 2 of a modified example embodiment of a thrust nozzle system.
Figure 3B:
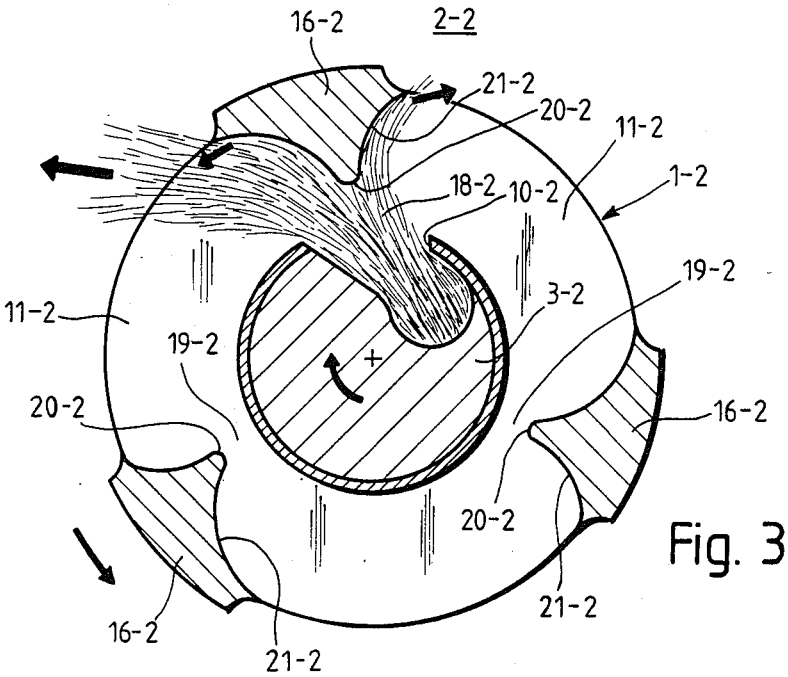

FIGS. 3*a* and 3*b* also show a cross-section through a thrust nozzle system 2—2, for the case of a projectile steering mechanism, corresponding to FIGS. 2*a* and 2*b*. The basic arrangement of the thrust nozzle system within the projectile is the same as that shown in FIG. 1. A rotating nozzle 3-2 with an eccentric thrust nozzle 10-2 is supported in the projectile 1-2. Three exhaust ports 11-2 are again provided and distributed around the circumference of the projectile. Each of the exhaust ports 11-2 covers a sector angle of approximately 90°. The exhaust ports 11-2 are separted by separation struts 16-2. The wall of the separation struts which faces the rotating nozzle body 3-2, is constructed in cross-section as an approximately nose-shaped separation body, comprising a nose 20-2 pointing toward the thrust nozzle 10-2. The walls 21-2 reach in a bow-shape from the nose 20-2 to the edge of the separation struts 16-2. These nose-shaped separation bodies steer or direct the thrust jet 18-2 over the total angle sector covered by an exhaust port 11-2 into a relatively homogeneous direction. That is, the separation bodies hold the thrust jet as long as possible in a defined direction, as may be seen in FIGS. 3*a* and 3*b*. In FIG. 3*a* the thrust jet 18-2 strikes the separation strut 16-2 in the lower left in the drawing, and then flows through the left exhaust port in an approximately horizontal direction indicated by the arrow. Only a small part of the thrust jet is steered by the nose 20-2 of the separation strut 16-2 into the adjacent bottom exhaust port 11-2. If the rotating nozzle body 3-2 rotates further, then the exhaust direction remains approximately the same when the thrust jet 18-2 separates from the wall 21-2 of the separation strut. When the thrust jet strikes the wall 21-2 of the next separation strut 16-2, the thrust jet is again steered or deflected by this wall into an approximately parallel exhaust direction in which the thrust jet is held in until it is steered over into the next exhaust port.

Figure 4:
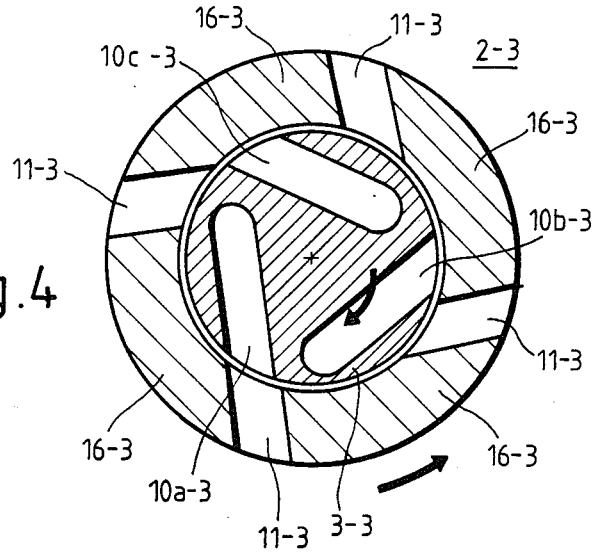
FIG. 4 shows a further example embodiment of a thrust nozzle system having several thrust nozzles, which may be utilized for a secondary injection system.

A null command may be achieved by means of this arranngement, in that the thrust jet is exactly split by the nose of a separation strut. Of course, the other possibilities set forth above are also conceivable. FIG. 4 shows again a cross-section through the tip of a projectile 1-3 with a thrust nozzle system 2-3 corresponding to that of FIGS. 2 and 3. The thrust nozzle system comprises a rotating nozzle 3-3, wherein now three angularly displaced thrust nozzles 10*a*-3, 10*b*-3, and 10*c*-3 are provided. Furthermore, four narrow exhaust ports 11-3 are provided, which are angularly arranged as extensions of the thrust nozzles 10-3. The arrangement of the thrust nozzles and of the exhaust ports according to FIG. 4 is such that, when one of the thrust nozzles, in this case the thrust nozzle 10*a*-3, is positioned opposite one of the exhaust ports 11-3, then both of the other thrust nozzles align with the separation struts 16-3 between the exhaust ports 11-3. Furthermore, in contrast to the two above described example embodiments, an interspace is not provided between the outlet of the thrust nozzle out of the rotating nozzle body and the separation strut. Thus, in the embodiment according to FIG. 4, gas practically only exits from the thrust nozzle 10*a*-3, while the gas exit out of the other thrust nozzles 10*b*-3 and 10*c*-3 is nearly eliminated.

A thrust nozzle system 2-3 according to FIG. 4 has the advantage of fast switching times, since for instance in the case shown, the rotating nozzle body must only be rotated approximately 30° so that the thrust nozzle 10*b*-3 is aligned opposite the next exhaust port 11-3. However, due to the lack of an interspace between the rotating nozzle body and the inner walls of the separation struts 16-3, in this embodiment one of the thrust nozzles must always communicate with one of the exhaust ports so that the rotation of the rotating nozzle body 3—3 can be maintained. This embodiment is a thrust nozzle system without a null or zero position, so that a null command can only be achieved by a fast free run of the rotating nozzle body 3—3. Of course, an interspace could also be provided in this embodiment between the rotating nozzle body 3—3 and the separation struts 16-3. In that case the requirement that one of the thrust nozzles always communicates with one of the exhaust ports need not be met. However,it is disadvantageous that the gas consumption then greatly increases through the three thrust nozzles.

If the thrust nozzle system according to FIG. 4 is driven by a liquid propellant or drive medium, it may, for example, be used in a secondary injection system, whereby one or several exhaust ports inject propellant laterally into the propulsion unit nozzle.

Figure 5A:
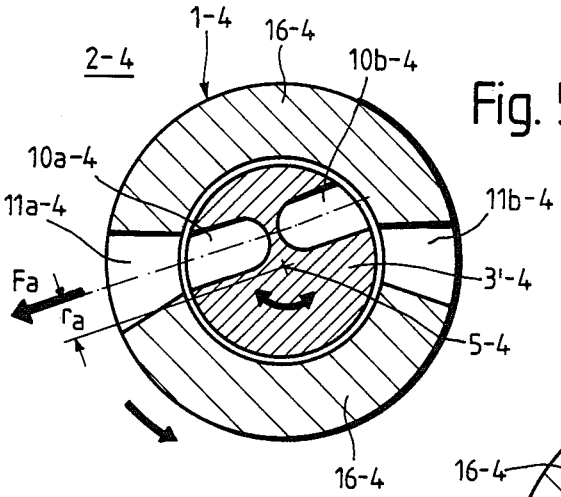
FIGS. 5*a* and 5*b* show a thrust nozzle system according to the invention having a swinging nozzle in two positions, whereby this thrust nozzle system may also be used for a secondary injection system.
Figure 5B:
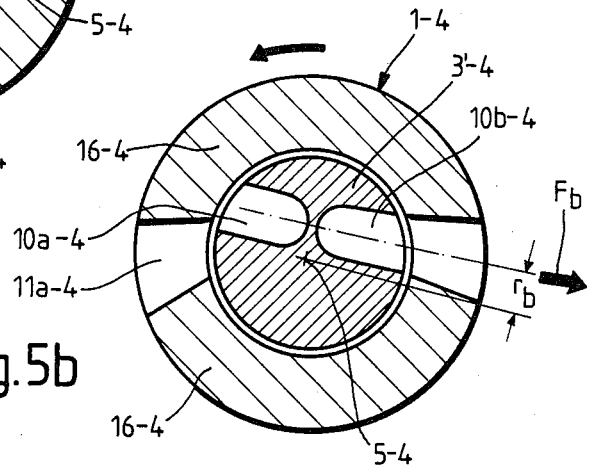

FIGS. 5*a* and 5*b* illustrate a thrust nozzle system 2-4 for steering a projectile 1-4. The thrust nozzle system 2-4 is built into the tip of a projectile corresponding to FIG. 1 as in the above described embodiments. Only a cross-section corresponding to the section line A—A in FIG. 1 is again shown.

Instead of the rotating nozzle body 3 as used above and which constantly rotates in one direction, here an oscillating or swinging nozzle body 3'-4 is provided, with two eccentric and opposedly directed thrust nozzles 10*a*-4 and 10*b*-4. Two narrow exhaust ports 11*a*-4 or 11*b*-4 are arranged for cooperation with the two thrust nozzles 10*a*-4 and 10*b*-4. In one position of the swinging nozzle body 3-4, the thrust nozzle 10*a*-4 communicates with the exhaust port 11*a*-4, whereas in the other position shown in FIG. 5*b*, the thrust nozzle 10*b*-4 communicates with the exhaust port 11*b*-4. The respective stream or jet directions and the forces Fa or Fb which thereby act upon the projectile 1-4 are shown in the figures. The respective lever arms $r_a$ or $r_b$ with respect to the rotation axis 5-4 of the swinging nozzle, are also shown. The rotation axis 5-4 coincides with the longitudinal axis of the projectile. It becomes clear from this illustration that a clockwise rotational moment is applied to the swinging nozzle body 3'-4 in the position accordig to FIG. 5*a*. Similarly, in the position of FIG. 5*b* a counterclockwise rotational moment is applied. The swinging nozzle body constantly oscillates or rocks back and forth between these two positions. In order to maintain the oscillation, either the oscillation must be stopped near the return points, for example by means of magnetic forces, corresponding to the principle of a clock balance or a spring-mass system, or artificial dead times must be introduced into the system.

The oscillation may be stopped for controlling the swinging nozzle arrangement, by means of a braking arrangement not shown here. In order to be able to apply steering forces in any desired directions to the projectile, it is necessary that the projectile 1-4 is rotating. In the figures a counterclockwise rotation around the longitudinal axis 5-4 of the projectile is assumed as indicated by an arrow.

Similarly, as in the example embodiment according to FIG. 4, essentially an interspace 19-1 is not provided between the respective closed thrust nozzle, in FIG. 5*a* the thrust nozzle 10*b*-4, and the projectile wall in order to prevent any unnecessary wasting gas from the gas source, for example, from the gas generator.

This thrust nozzle system may also be used for a secondary injection system in a flying body. In such a case, for example, the exhaust port 11*a*-4 is a port in the size of the propulsion unit nozzle wall for injecting secondary propellant, while the other exhaust port 11*b*-4 leads to the outside, and the thrust jet guided therethrough serves to aid in the acceleration of the flying body in a different direction, for instance, in the opposite direction. The exhaust port 11*b*-4 may also be guided to the tail of the flying body, in order to aid the forward thrust of the flying body.

Figure 6:
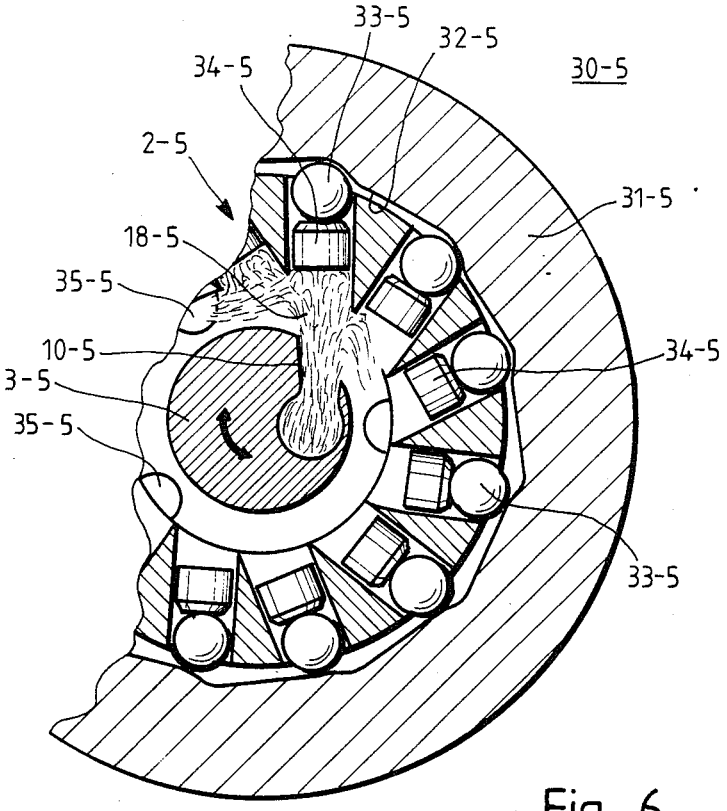
FIG. 6 shows a partial cross-section through a miniature hot gas motor, having a thrust nozzle system according to the invention.

FIG. 6 shows a partial cross-section through a miniature hot gas motor 30-5 cooperating with a thrust nozzle system 2-5 of the described type. The principle of operation of such motors is known. Balls or spheres 33-5, which roll along a cam curve 32-5, act upon an output or driving ring 31-5 which comprises the inner cam curve 32-5. The balls are moved by means of pistons, in this case free pistons 34-5. Customarily, such a motor is hydraulically activated. In this case, a rotating nozzle body 3-5, corresponding to the one shown in FIG. 2, is arranged centrally in the motor. The rotating nozzle body 3-5 with an eccentric thrust nozzle 10-5 is set into a fast clockwise rotation by a gas generator which is not shown here. A braking arrangement not shown here, but corresponding to the above braking arrangement 14-1 serves to hold or stop the rotating nozzle body in a defined position.

As shown in FIG. 6, the rotating nozzle body 3-5 is held by the braking arrangement which is not shown, so that the thrust jet 18-5 strikes a free piston 34-5. Hereby, the ball 33-5 supported in front of the piston 34-5 is pressed against the cam curve 32-5 of the drive ring 31-5, whereby the ring is rotated clockwise. When the corresponding cam curve section for this ball has been passed through, the rotating nozzle body 3-5 is released and then stopped again only when the thrust jet 18-5 strikes the next free piston, whereby a continuous, down-geared rotation of the drive ring may be achieved. Exhaust channels 35-5 are provided in the motor for exhausting the gases.

Such a motor can be aided in its motion by the flow conditions. When the thrust jet strikes a free piston, the piston chamber is simultaneously filled with gas. As soon as the piston chamber is full, a back pressure arises. If the rotating nozzle body is appropriately constructed, this back pressure may be used to turn the nozzle body further until the thrust stream enters the next piston chamber. Such a possibility exists, for example, when the rotating nozzle body is equipped with a one-sided, tangential impingement plate arranged parallel to the output of the thrust stream 18-5. In such a case, the thrust nozzle can even be arranged directly radially, since the torque moment necessary for driving the rotating nozzle body 3-5 is provided by the eccentric impingement plate.

The described thrust nozzle system has the advantage of very small shifting or switching times due to the low inertia of the rotating nozzle body or swinging nozzle body. Furthermore, it has the advantage that a high miniaturization can be achieved due to the simple construction. These advantages outweigh the disadvantage of a relatively small efficiency in many instances, for example, in the indicated steering of projectiles of small caliber. Even though it was not mentioned in the above example embodiments, it is of course possible not to combine the drive of the rotating or swinging nozzle body with the thrust nozzle.

Rather, it is possible to produce the drive and thrust force at different locations of the nozzle body. Thus, the drive may be achieved for example by means of an eccentric nozzle, whereas the thrust may be applied by a direct radial nozzle. Also, the thrust nozzle system may be used for steering underwater torpedoes or the like.

Although the invention has been described with reference to specific example embodiments, it will be appreciated that it is intended to cover all modifications and equivalents within the scope of the appended claims.

I claim:

1. In a thrust nozzle system wherein a rotatable jet deflector nozzle body having a longitudinal axis and at least one thrust nozzle is supported for rotation in a housing having at least one exhaust port arranged for cooperation with said thrust nozzle of said jet deflector nozzle body, wherein a propellant source provides a gas flow through said jet deflector nozzle body, and wherein means are provided for controlling the rotation of said jet deflector nozzle body, the improvement comprising means for constantly supplying said gas flow to said jet deflector nozzle body for continuously rotating said jet deflector nozzle body, and wherein said means for controlling comprise a braking device (13, 14, 15) operatively interposed between said jet deflector nozzle body (3) and said housing for stopping the rotation of said jet deflector nozzle body independently of said gas flow, said thrust nozzle having an inlet channel extending substantially in parallel to said longitudinal axis (5) about which said jet deflector nozzle body is rotatable, and a nozzle outlet channel extending approximately perpendicularly to said inlet channel, said nozzle outlet channel extending along a chord spaced from said longitudinal axis, whereby a thrust jet out of said nozzle outlet channel reacts against a rear wall in said jet deflector nozzle body.

2. The thrust nozzle system of claim 1, further comprising a plurality of exhaust ports in said housing and separation struts in said housing for separating said exhaust ports from one another.

3. The thrust nozzle system of claim 2, wherein said separation struts have walls facing said rotating jet deflector nozzle body which are constructed as jet splitters.

4. The thrust nozzle system of claim 3, wherein said jet splitters have a nose shaped profile.

5. The thrust nozzle system of claim 2, wherein said separation struts have walls facing said rotating jet deflector nozzle body, which are constructed as flat impingement surfaces.

6. The thrust nozzle system of claim 1, wherein said jet deflector nozzle body comprises two oppositely directed eccentric thrust nozzle outlet channels, said housing comprising an exhaust port for each of said two thrust nozzle outlet channels, said two thrust nozzle outlet channels having a common axis spaced from said longitudinal axis to provide a certain lever arm ($r_a$, $r_b$), said exhaust ports being located in said housing for alternately cooperating with the respective one of said two oppositely directed eccentric thrust nozzle outlet channels for an oscillating back and forth movement of said jet deflector nozzle body.

7. The thrust nozzle system of claim 1, wherein said jet deflector nozzle body comprises three thrust nozzle outlet channels, said housing having four exhaust ports, said outlet channels being angularly displaced relative to each other so that at any time only one thrust nozzle outlet channel is aligned with one of said four exhaust ports in said housing.

8. The thrust nozzle system of claim 1, wherein said braking device comprises a first brake disk (13) rigidly secured to said jet deflector nozzle body, a second brake disk (14) axially movable in said housing, and two friction members (15), one friction member being secured to said housing on one side of said first brake disk, the other friction member being secured to said second axially movable brake disk (14) for clamping said first brake disk between said two friction members for stopping said jet deflector nozzle body in any position.

9. The thrust nozzle system of claim 1, further comprising an interspace (19-1) between said housing and said jet deflector nozzle body for providing a space in which a jet splitting may take place.

10. The thrust nozzle system of claim 1, wherein said jet deflector nozzle body has a moment of inertia sufficiently small for a high speed rotation of said jet deflector nozzle body and for a rapid acceleration at the start of rotation.

* * * * *